US007049748B2

(12) United States Patent
Tokai et al.

(10) Patent No.: US 7,049,748 B2
(45) Date of Patent: May 23, 2006

(54) DISPLAY DEVICE EMPLOYING GAS DISCHARGE TUBES ARRANGED IN PARALLEL BETWEEN FRONT AND REAR SUBSTRATES TO COMPRISE A DISPLAY SCREEN, EACH TUBE HAVING A LIGHT EMITTING SECTION AS PART OF THE DISPLAY SCREEN AND A CLEANING SECTION CONNECTED TO THE LIGHT EMITTING SECTION BUT DISPLACED FROM THE DISPLAY SCREEN

(75) Inventors: Akira Tokai, Kawasaki (JP); Hitoshi Yamada, Kawasaki (JP); Manabu Ishimoto, Kawasaki (JP); Tsutae Shinoda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/262,885

(22) Filed: Oct. 3, 2002

(65) Prior Publication Data

US 2003/0122485 A1 Jul. 3, 2003

(30) Foreign Application Priority Data

Dec. 28, 2001 (JP) ..... 2001-400733

(51) Int. Cl.
*H01J 17/49* (2006.01)
*H01J 61/30* (2006.01)

(52) U.S. Cl. ..... 313/582; 313/562; 313/493; 313/494; 313/607; 313/553; 313/554; 313/234; 362/260

(58) Field of Classification Search ..... 313/582, 313/562, 607, 553, 554, 234, 493, 494
See application file for complete search history.

(56) References Cited

U.S. PATENT DOCUMENTS

| | | | | |
|---|---|---|---|---|
| 2,855,368 | A | * | 10/1958 | Pordijk et al. ..... 252/181.6 |
| 3,801,850 | A | * | 4/1974 | Maegdefessel et al. ..... 313/558 |
| 4,461,981 | A | * | 7/1984 | Saikatsu et al. ..... 315/246 |
| 5,049,777 | A | * | 9/1991 | Mechtersheimer ..... 313/35 |
| 5,294,422 | A | * | 3/1994 | Kitahara et al. ..... 423/245.1 |
| 5,514,934 | A | * | 5/1996 | Matsumoto et al. ..... 313/607 |
| 5,754,000 | A | * | 5/1998 | Skilton et al. ..... 313/565 |
| 6,331,064 | B1 | * | 12/2001 | Nishiyama et al. ..... 362/260 |

FOREIGN PATENT DOCUMENTS

| | | | |
|---|---|---|---|
| JP | 49-13907 | | 3/1974 |
| JP | SHO 61-103187 | | 5/1986 |
| JP | 6-338302 | | 12/1994 |
| JP | 08017405 | A * | 1/1996 |
| JP | HEI 11-162385 | | 6/1999 |
| KR | 2001044259 | A * | 6/2001 |

* cited by examiner

*Primary Examiner*—Ashok Patel
*Assistant Examiner*—Sikha Roy
(74) *Attorney, Agent, or Firm*—Staas & Halsey LLP

(57) ABSTRACT

A gas discharge tube has a phosphor layer formed and a discharge gas enclosed within an elongated tube which is to serve as the gas discharge tube. The gas discharge tube includes a light-emitting section and a cleaning section for cleaning the discharge gas. The cleaning section is connected to the light-emitting section.

11 Claims, 12 Drawing Sheets

DISPLAY DEVICE EMPLOYING GAS DISCHARGE TUBES ARRANGED IN PARALLEL BETWEEN FRONT AND REAR SUBSTRATES TO COMPRISE A DISPLAY SCREEN, EACH TUBE HAVING A LIGHT EMITTING SECTION AS PART OF THE DISPLAY SCREEN AND A CLEANING SECTION CONNECTED TO THE LIGHT EMITTING SECTION BUT DISPLACED FROM THE DISPLAY SCREEN

CROSS-REFERENCE TO RELATED APPLICATION

This application is related to Japanese application No. 2001-400733 filed on Dec. 28, 2001, whose priority is claimed under 35 USC §119, the disclosure of which is incorporated by reference in its entirety.

BACKGROUND OF THE INVENTION

1. Field of the Invention

The present invention relates to a gas discharge tube. More particularly, it relates to a gas discharge tube preferably applied to a display device in which the gas discharge tubes, made of elongated tubes, of a diameter of about 0.5 to 5 mm are arranged parallel to each other to constitute a display screen.

2. Description of Related Art

In general, PDPs (plasma display panels), known as panels for large-scale display, are so constructed that a pair of substrates each having electrodes formed thereon are disposed opposite to each other with a periphery thereof sealed and a discharge gas enclosed in a discharge space defined between the substrate pair. Apart from such PDPs, display devices in which a plurality of luminous bodies (tubular luminous bodies: gas discharge tubes) are arranged parallel to each other are also known.

In the above display devices, electrodes are formed outside (or inside) elongated, hollow, glass tubes of a diameter of about 0.5 to 5 mm, and luminous bodies having a discharge gas enclosed therein and phosphor layers formed on an internal wall surface are arranged in a row direction (or in a column direction) to constitute a display screen. As such display devices, are known a large-scale gas discharge display panel described in Japanese Unexamined Patent Publication No. Sho 61(1986)-103187, an image display device described in Japanese Unexamined Patent Publication No. Hei 11(1999)-162385 and the like.

These display devices having the gas discharge tubes and used for large-scale display are advantageous in reduced number of fabrication steps, reduced weight and costs, and ease of screen size change.

However, in the gas discharge tubes applied to such display devices, it sometimes occurs that the discharge gas within the discharge tube tends to be contaminated, thereby affecting the discharge characteristics. Namely, the discharge tubes have so small a diameter that water, carbon dioxide or the like adsorbed on surfaces of secondary electron emission layers or the phosphor layers is difficult to sufficiently remove when impurity gases are evacuated. This incurs a problem of impurity gases being liable to generate from the secondary electron emission layers or the phosphor layers formed in the gas discharge tubes during electric discharges generated by the discharge gas enclosed in the discharge tubes. Moreover, the discharge tubes have a volume so small as to be affected severely by the impurity gases.

SUMMARY OF THE INVENTION

The present invention has been made in view of the above circumstances. An object of the present invention is to suppress deterioration of the discharge characteristics caused by a discharge gas, by providing a gas discharge tube with a section for cleaning the discharge gas to clean off impurity gases generated during electric discharges.

The present invention provides a gas discharge tube having a phosphor layer formed and a discharge gas enclosed within an elongated tube, the elongated tube being to serve as the gas discharge tube, comprising: a light-emitting section and a cleaning section for cleaning a discharge gas, the cleaning section being connected to the light-emitting section.

According to the present invention, the discharge gas is kept clean by the cleaning section, and deterioration of the discharge characteristics is prevented.

DESCRIPTION OF THE PREFERRED EMBODIMENTS

Figure 1:
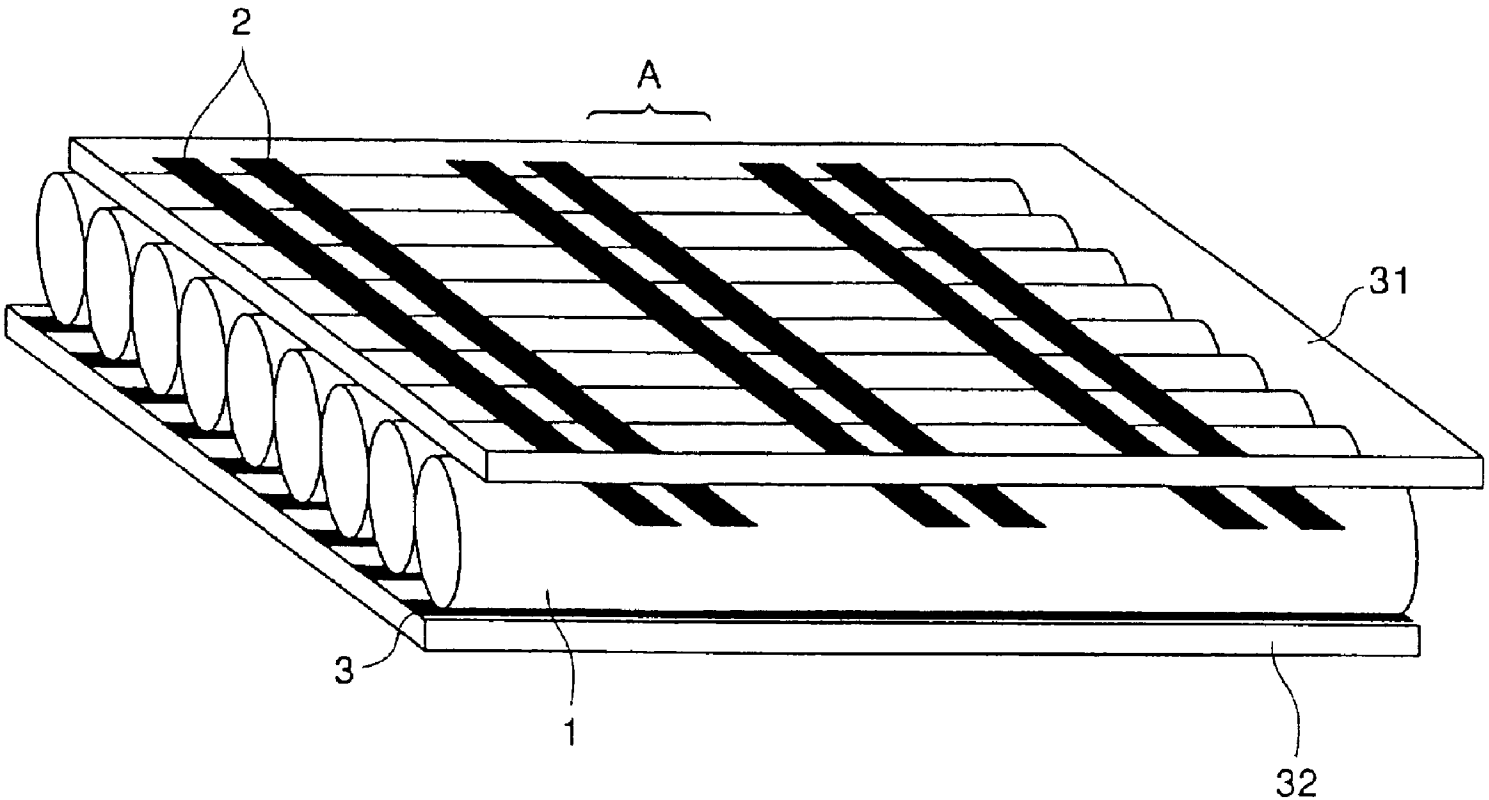
FIG. 1 is an explanatory view illustrating an embodiment in which the gas discharge tubes of the present invention are used.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In the present invention, the phosphor layer, electrode and discharge gas can be any if they are known in the art. The light-emitting section can be any if it is constituted by the elongated tubes and emits light by electric discharges between the electrodes. The phosphor layer is formed within the elongated tube. The electrodes may be disposed either inside or outside the elongated tubes. The discharge gas is enclosed in the elongated tube.

The cleaning section may be filled with the same discharge gas as that enclosed in the light-emitting section and is composed of a reserve tank so as to allow free flow of the discharge gas between the reserve tank and the light-emitting section. The cleaning section may be composed of a getter section containing a getter for adsorbing thereon impurity gases mixed with the discharge gas enclosed in the light-emitting section. The getter may be disposed within the reserve tank. As a getter agent used for the getter, a nonvolatile getter agent is desirably used to prevent contamination of the light-emitting section of a display device. As the nonvolatile getter agent, may be used one containing, as a main ingredient, Zr (zirconium) or V (vanadium). For example, St 172 or St 707, manufactured by SAES GETTERS, may be employed. St 172 is a getter agent of a type which is activated by halogen-lamp irradiation or high-frequency heating after enclosure of a gas. St 707 is a getter agent of another type which is activated depending on a temperature during heating of a discharge tube for evacuation of impurity gases. The cleaning sections may be provided at both ends of the elongated tube, and in that case, they desirably have substantially the same width as the dimension of the diameter of the elongated tube. Alternatively, the cleaning section may be provided at one end of each elongated tube and the cleaning sections of alternate tubes staggered, i.e., disposed at opposite ends of the panel, and in that case, each cleaning section desirably has a width substantially twice the dimension of the diameter of the associated, elongated tube.

The gas discharge tube can be produced by forming the phosphor layer and enclosing the discharge gas in the elongated tube, and the discharge tubes can be arranged parallel to each other to constitute a display screen and applied to a display device.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The gas discharge tubes of the present invention are arranged parallel to each other to constitute a display screen, and applied to a display device for displaying desired images. Accordingly, an embodiment of the display device will be described.

FIG. 1 is an explanatory view illustrating an embodiment in which the gas discharge tubes of the present invention are used.

In the drawing, reference numeral 31 indicates a front substrate, 32 a rear substrate, 1 gas discharge tubes, 2 display electrode pairs (main electrode pairs), and 3 signal electrodes (data electrodes).

Inside an elongated glass tube, which is to serve as the gas the discharge tube 1, (within a discharge space), a phosphor layer is formed, a discharge gas is introduced, and both ends of the elongated tube are sealed. The signal electrodes 3 are formed on the rear substrate 32, in a longitudinal direction of the tubes 1. The display electrode pairs 2 are formed on the front substrate 31, in a direction crossing the signal electrodes 3. Non-discharge regions A (non-luminous areas) are provided between adjacent display electrode pairs 2.

In assembly of the display device, the signal electrodes 3 and the display electrode pairs 2 are closely contacted with an outer periphery of the tube 1 at an upper side and a lower side, respectively. A conductive adhesive may be interposed between the display electrode 2 and the outer periphery of the tube 1 at the upper side to improve the contact therebetween.

The substrates 31 and 32 having the electrodes thereon may be of a flexible material such as resin. A transparent insulative adhesive may be interposed between the substrates 31 and 32 for their adhesion to each other so that they are closely contacted along surfaces of the gas discharge tubes.

An area where the signal electrode 3 intersects the display electrode pair 2 is a unit luminous area, when the display device is viewed in plan. Display is performed as follows. Using, as a scanning electrode, either electrode of the display electrode pair 2, a selection discharge is generated at the area where the scanning electrode intersects the signal electrode 3 so as to select a luminous area. Utilizing, simultaneously with emission of light, a wall charge provided within the tube in the luminous area, display discharges are generated between the display electrode pair 2. A selection discharge is an opposite discharge generated within the tube 1 between the scanning electrode and the signal electrode 3, opposed to each other in a vertical direction. A display discharge is a surface discharge generated within the tube 1 between the display electrode pair 2, disposed parallel to each other on a plane.

Also, such a display device that a large number of gas discharge tubes are arranged parallel to each other may be constructed by previously forming the display electrode pairs 2 in dots and the signal electrodes 3 in stripes on outer surfaces of the gas discharge tube 1 by printing, vapor deposition or the like; forming electrodes for supplying electric power both on the front substrate 31 and the rear substrate 32; and respectively contacting, in assembly of the gas discharge tube 1, the electrodes for supplying electric power with the display electrode pairs 2 and the signal electrodes 3.

Figure 2:
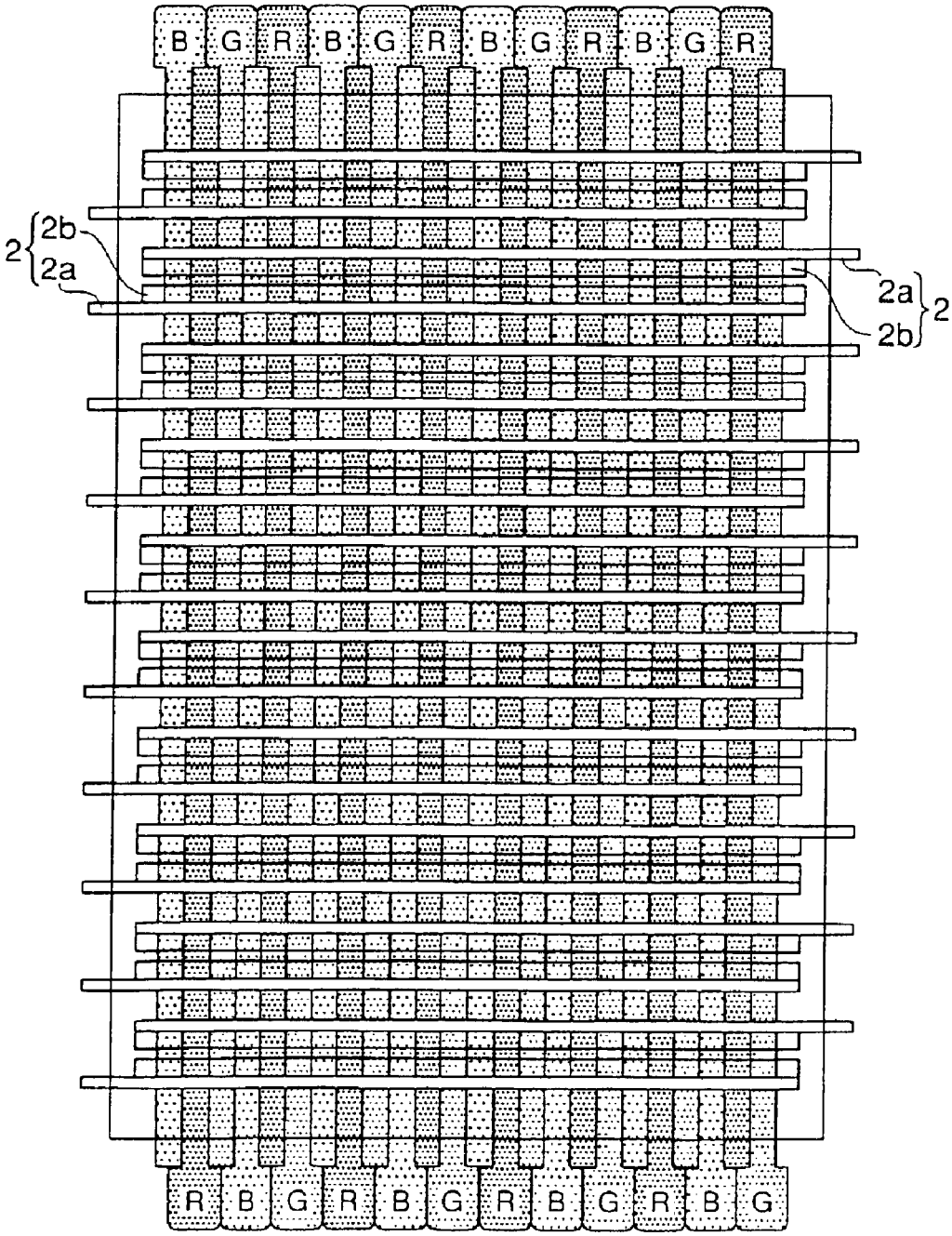
FIG. 2 is an explanatory plan view illustrating a display device in which the gas discharge tubes of the present invention are arranged parallel to each other.

FIG. 2 is an explanatory plan view illustrating a display device in which the gas discharge tubes of the present invention are arranged parallel to each other. In this display device, the display electrode pair 2 is composed of a bus electrode 2*a* and a transparent electrode 2*b*. The signal electrode is not illustrated.

Figure 3:
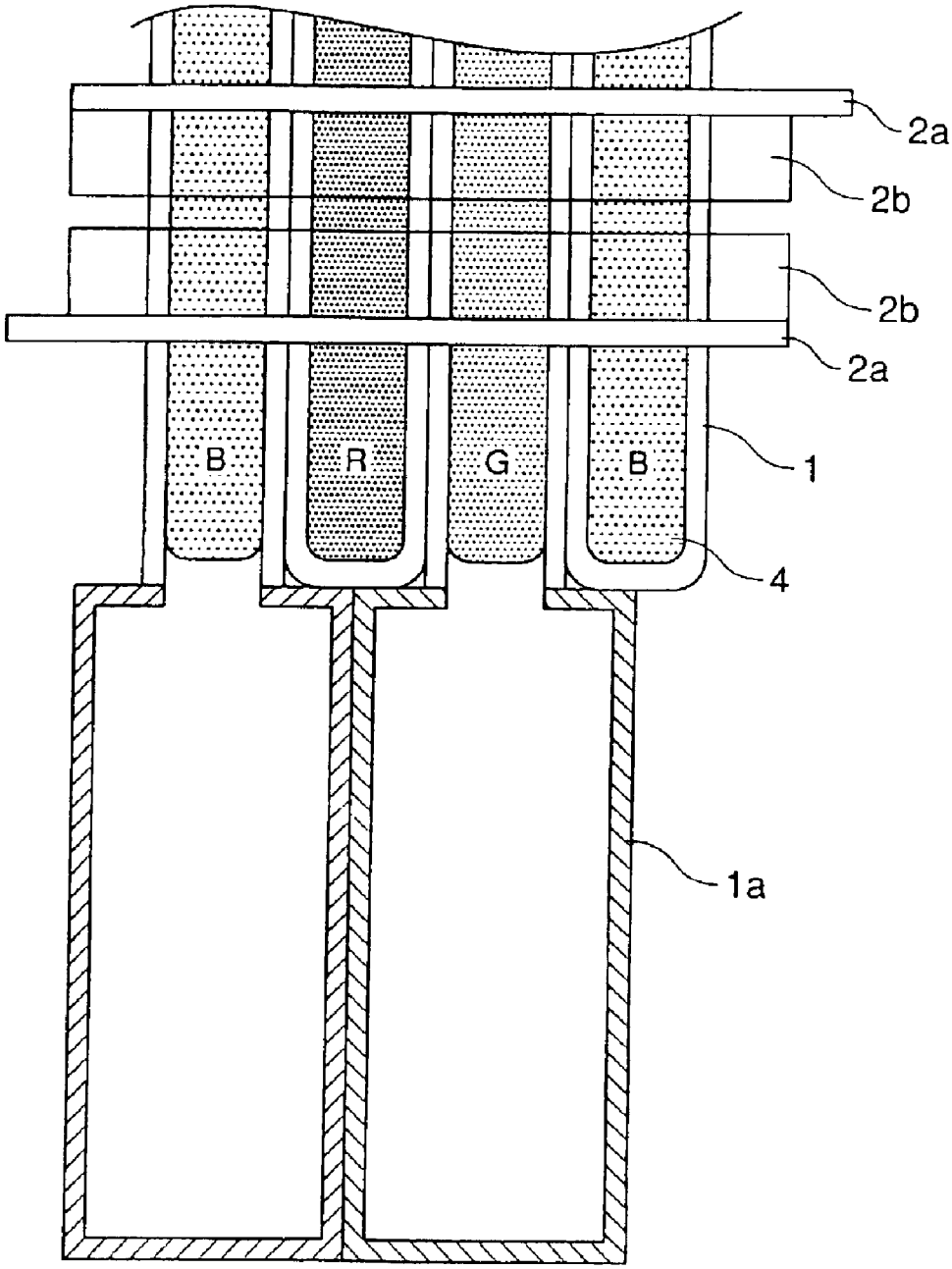
FIG. 3 is an explanatory view illustrating ends of the gas discharge tubes of FIG. 2 extending outside a light-emitting section.

FIG. 3 is an explanatory view illustrating ends of the gas discharge tubes of FIG. 2 extending outside a light-emitting section.

In FIG. 3, reference numeral 4 denotes phosphor layers formed in the elongated tubes. As illustrated in this drawing, a reserve tank 1*a* as a section for cleaning the discharge gas is provided at one end of the gas discharge tube extending outside the light-emitting section. The reserve tank 1*a* is connected to and integrated with the gas discharge tube at one end thereof, so that the discharge gas (for example, Ne: 96% and Xe: 4%) enclosed in the reserve tank 1*a* can flow freely through the gas discharge tube.

The reserve tank 1*a* is made of metal or ceramic and has a circular cross section with a diameter of the circle being twice the diameter of the elongated tube. Alternatively, the reserve tank 1*a* may have a square cross section with a side of the square being twice the diameter of the elongated tube.

Desirably, each reserve tank 1*a* has a large volume and if possible, has a volume 50% of, and thus smaller than, or 100% of, and thus equal to, the volume of the light-emitting section of the respective gas discharge tubes. However, the reserve tank 1*a* has a volume properly set in consideration of the size when it is applied to the display device. The reserve tank 1*a* is of a length set accordingly.

Thus, the reserve tank 1*a* is provided at one end of the gas discharge tube 1 to allow it to function as a buffer tank for impurity gases generated by electric discharges for reducing the concentration of the impurity gases, so that stabilized electric discharges are intended.

Namely, in gas discharge tubes, impurities in the discharge gas affect the discharge characteristics. Especially in gas discharge tubes that employ the elongated tubes of a small inner volume according to the present invention, the discharge characteristics are severely deteriorated when substances adsorbed on a surface of, for example, a secondary electron emission layer formed on an internal wall surface of the elongated tube are emanated into a discharge space. For this reason, the reserve tank is provided at one end of the gas discharge tube and used as a buffer tank for the impurity gases generated by electric discharges so as to suppress deterioration of the discharge characteristics to a minimum extent.

When the gas discharge tubes 1 are arranged parallel to each other and applied to the display device, the reserve tanks are staggered so that alternate ones are disposed at the same side of the display device, as shown in FIG. 3.

The reserve tank 1*a* may have a cross section of an ellipse or a rectangle with a shorter diameter of the ellipse or a shorter side of the rectangle being about twice the dimension of the diameter of the discharge tube. The length of a longer diameter of the ellipse or the length of a longer side of the rectangle is not especially limited. Owing to this, the gas discharge tubes can be arranged parallel to each other without any intervals therebetween and applied to a display device even if the reserve tank has an elliptical or rectangular cross section, as in the case where it has a circular or square cross section.

In the above embodiment, the reserve tank is provided at only one end of each gas discharge tube. However, the reserve tanks may be provided at both ends of the discharge tube. In that case, the reserve tank has a cross section of an ellipse or rectangle with a shorter diameter of the ellipse or a shorter side of the rectangular being of about the same dimension as the diameter of the discharge tube. In this case also, the length of a longer diameter of the ellipse or the length of a longer side of the rectangle is not especially limited. Owing to this, the gas discharge tubes can be arranged parallel to each other without any intervals therebetween and applied to the display device even if the reserve tanks are provided at both ends of the discharge tube, as in the case where the reserve tank is provided at only one end of the discharge tube.

Figure 4:
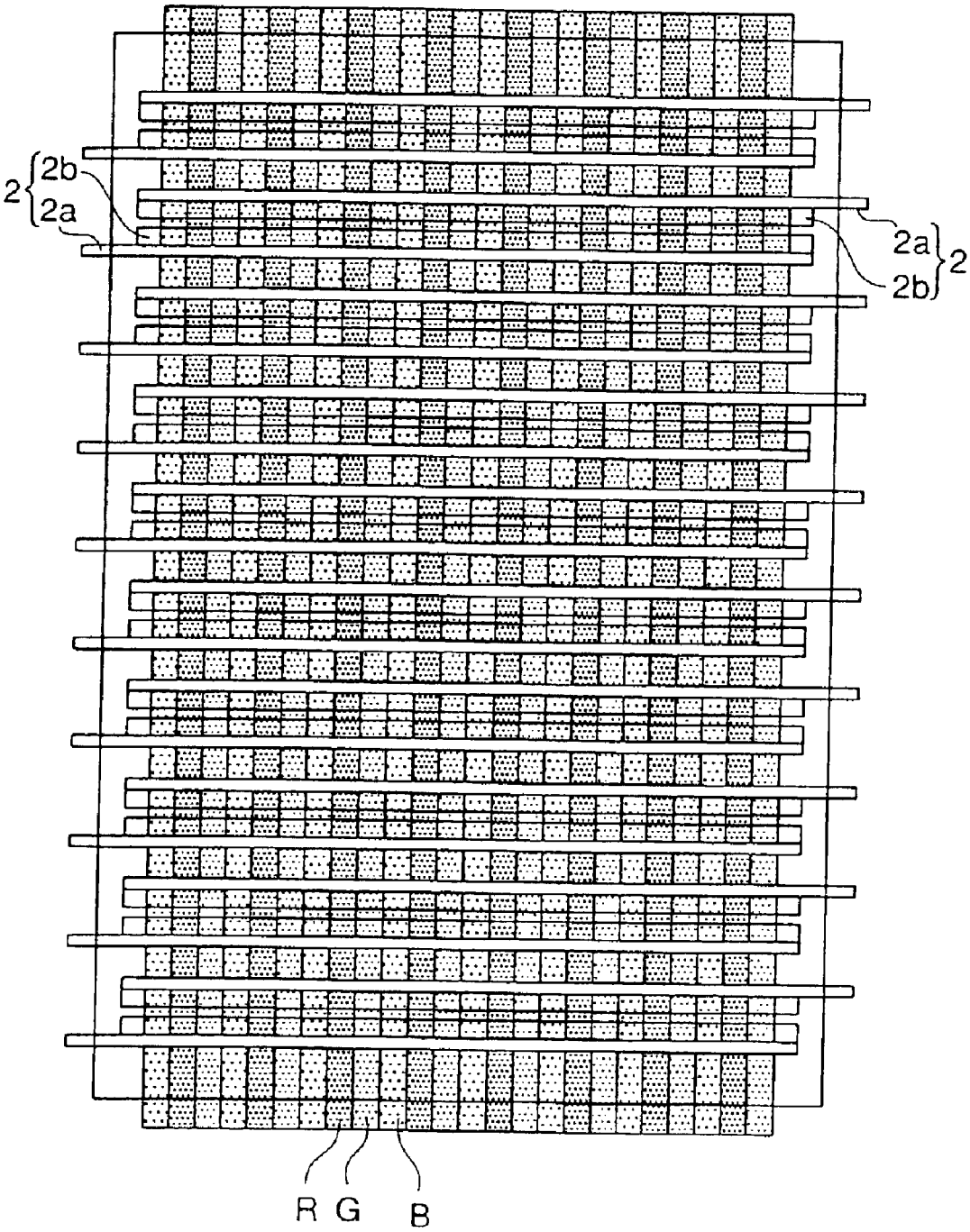
FIG. 4 is an explanatory plan view illustrating a display device in which getter sections are provided at ends of the gas discharge tubes and the gas discharge tubes are arranged parallel to each other.

FIG. 4 is an explanatory plan view illustrating a display device in which getter sections are provided at ends of the gas discharge tubes and the gas discharge tubes are arranged parallel to each other. In this display device also, the display electrode pair 2 is composed of the bus electrode 2*a* and the transparent electrode 2*b*. The signal electrode is not illustrated.

Figure 5:
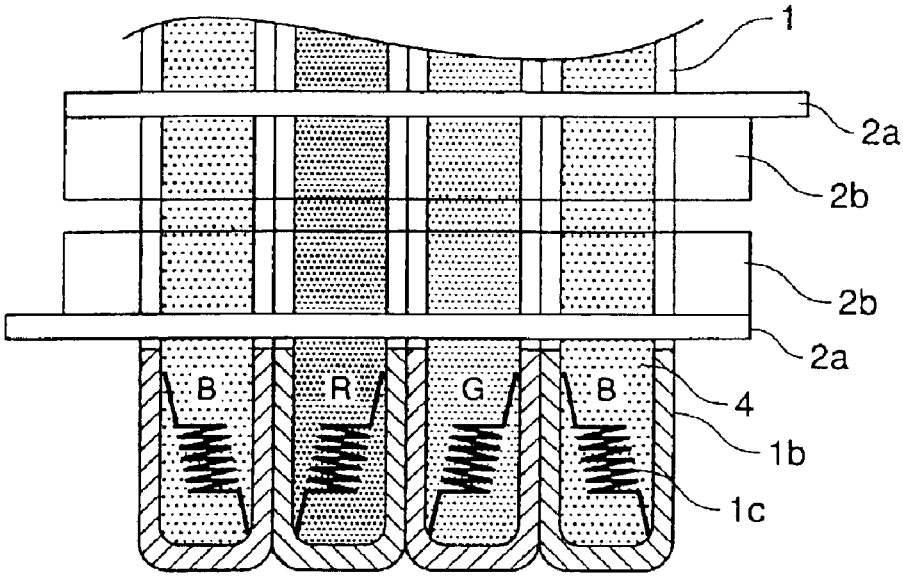
FIG. 5 an explanatory view illustrating the ends of the gas discharge tubes of FIG. 4 extending outside the light-emitting section.

FIG. 5 is an explanatory view illustrating the ends of the gas discharge tubes of FIG. 4 extending outside the light-emitting section.

In this embodiment, a getter section 1*b* as the section for cleaning the discharge gas is provided at one end of the gas discharge tube extending outside the light-emitting section. The getter section 1*b* is connected to and integrated with the gas discharge tube 1 at one end thereof so as to allow free flow of the discharge gas enclosed in the getter section 1*b* through the gas discharge tube.

A getter 1*c* for adsorbing the impurity gases thereon is disposed in the getter section 1*b*. As for a getter agent used for the getter 1*c*, a nonvolatile getter agent is used to prevent contamination of luminous surfaces (phosphor layer surface and secondary electron emission layer surface) of the gas discharge tube. In the present embodiment, St 707, manufactured by SAES GETTERS, is employed as the nonvolatile getter agent. The St 707 is activated depending on a temperature during heating of the discharge tube for evacuation of the impurity gases.

The getter section 1*b* is made of glass, the same material as that of the gas discharge tube, or of metal or ceramic, and has the same cross section as that of the gas discharge tube. The getter section 1*b* may have a square cross section with the side of the square being of the same length as the diameter of the gas discharge tube 1.

Thus, the getter section 1*b* is provided at one end of the gas discharge tube 1 to allow the getter 1*c* to adsorb the impurity gases thereon, so that stabilized electric discharges are achieved.

In the above embodiment, the getter sections 1*b* are provided and the getters 1*c* are disposed therein. However, the getters 1*c* may be disposed within the reserve tanks mentioned above. If the getters 1*c* are disposed within the reserve tanks, the efficiency of adsorbing the impurity gases is enhanced because the getters 1*c* sufficiently contact with the discharge gas.

In the above embodiment, the getters are provided at only one end of the gas discharge tube. However, the getters may be provided at both ends of the gas discharge tube depending on the amount of the impurity gases to be adsorbed.

Figure 6:
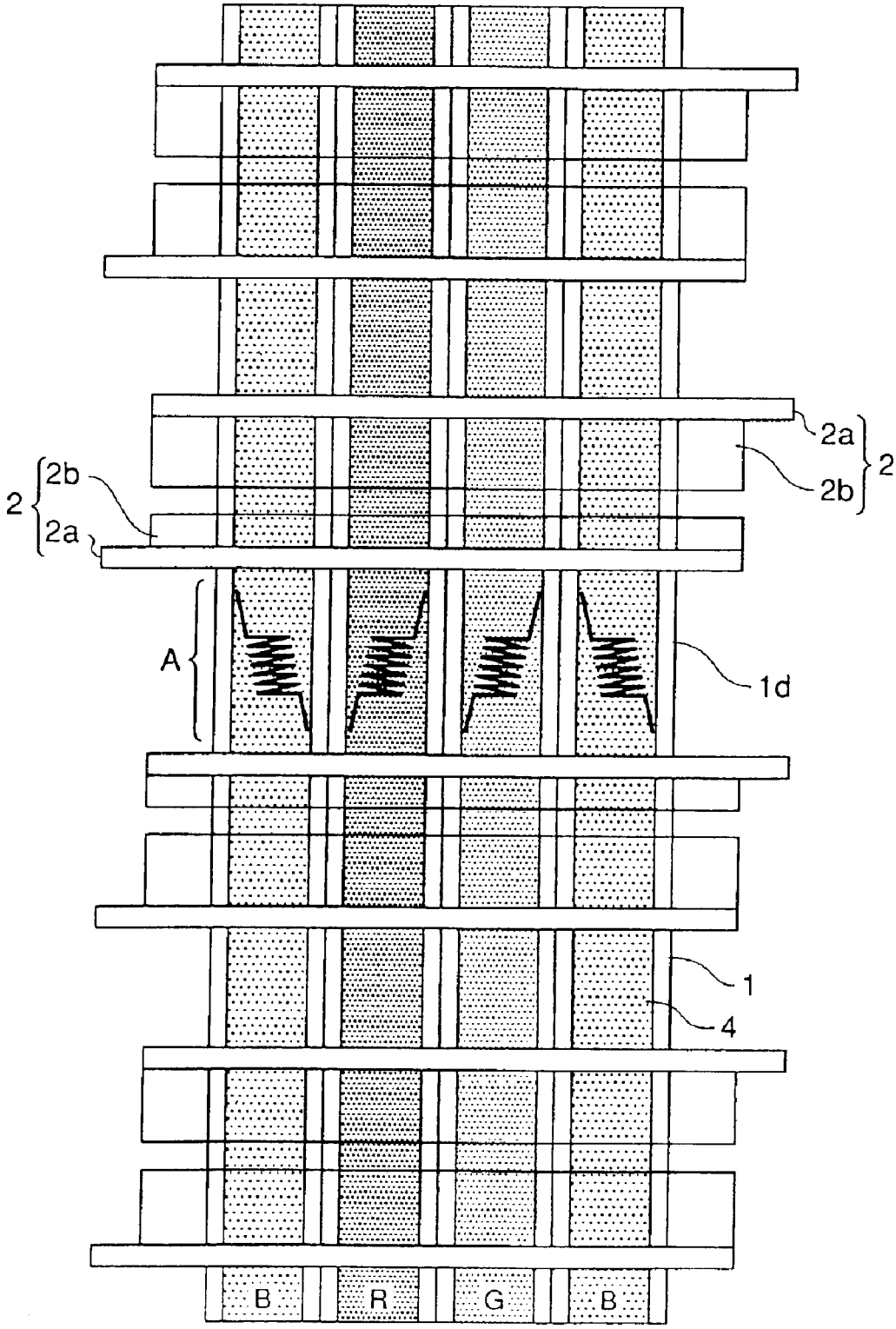
FIG. 6 is an explanatory plan view illustrating a display device in which the getter sections are disposed at the centers of the gas discharge tubes.

FIG. 6 is an explanatory plan view illustrating a display device in which the getter sections are disposed at the centers of the gas discharge tubes. In this display device also, the display electrode pair 2 is composed of the bus electrode 2*a* and the transparent electrode 2*b*. The signal electrode is not illustrated.

The gas discharge tube 1 according to the present embodiment has a getter section 1*d* at the center thereof. The getter section 1*d* at the center is formed in a region to serve as the non-discharge region A when the display device is fabricated by arranging the plurality of the gas discharge tubes parallel to each other. The non-discharge region A is interposed between two adjacent display electrode pairs 2 in which the width of the respective transparent electrodes 2*b* is reduced thereby to afford a spacing therebetween, defining the region A, which is greater than the corresponding regions between successive electrode pairs 2, on either side of the region A. In other words, the larger spacing available to define the region A is achieved by reducing the width of the adjacent transparent electrodes 2*b* of the electrode pairs 2 between which the region A is defined, as is readily seen in FIG. 6.

In the present embodiment, the getter section 1*d* is inserted and placed in the gas discharge tube (specifically, the getter is formed together with the phosphor layer on a substrate, and then the substrate is inserted into the elongated tube). However, the getter section 1*d* may be provided, in a manner similar to that of the embodiment of FIG. 5, by preparing a glass tube separately from the elongated tubes; placing the getter section 1*d* in the glass tube; and interposing the glass tube between two elongated tubes with their ends opposed to each other. In that case, the glass tube may be of any shape if the width is of the same dimension as that of the diameter of the elongated tube, and the glass tube may protrude from the rear surface of the display device.

Figure 7:
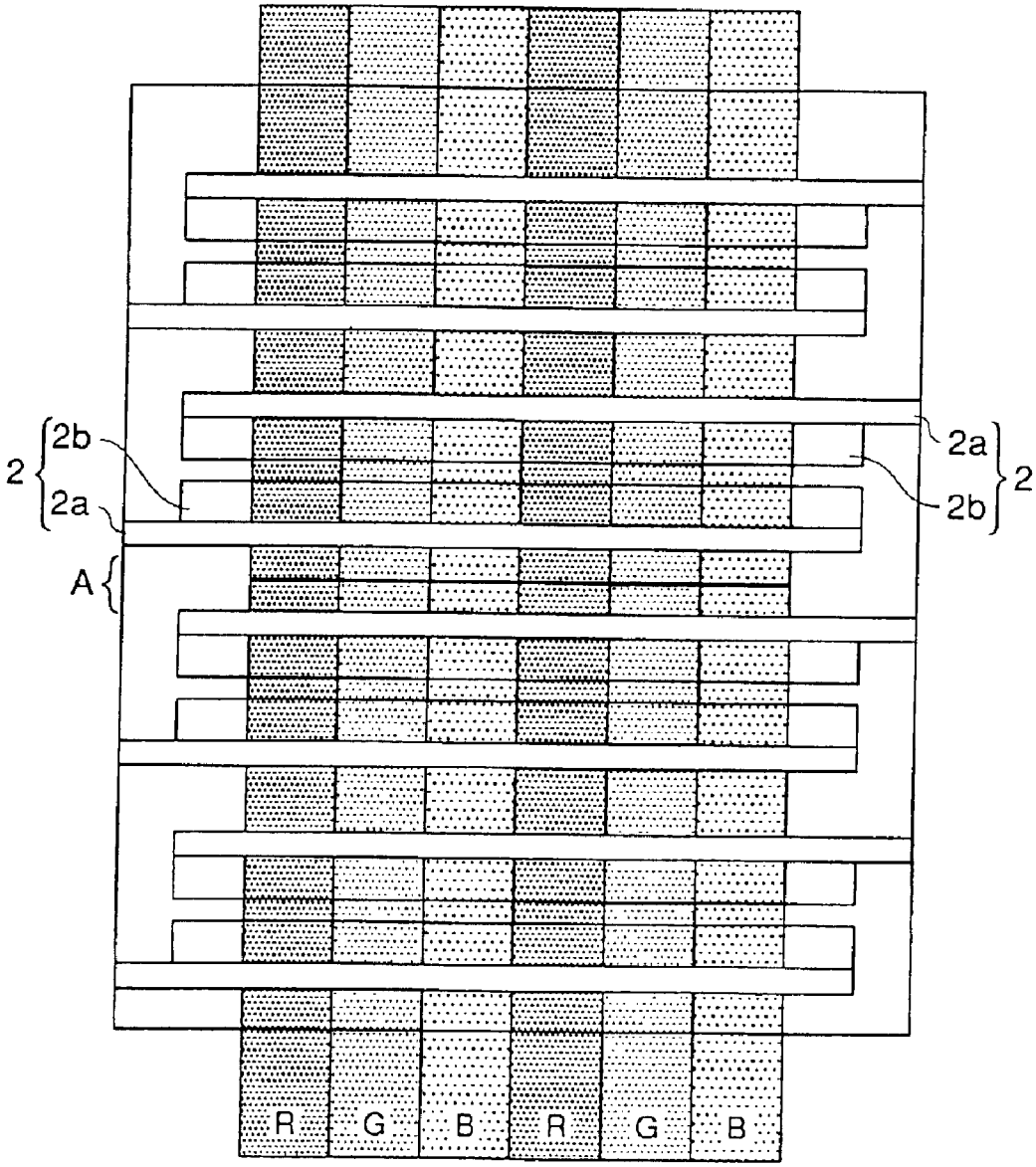
FIG. 7 is an explanatory view illustrating an example of a large-scale display device fabricated using shorter elongated tubes.

FIG. 7 is an explanatory view illustrating an example of a large-scale display device fabricated using shorter elongated tubes.

If a gas discharge tube is produced with a longer elongated tube having a small diameter, it is difficult to favorably form, in the longer elongated tube, the secondary electron emission layer made of MgO or the phosphor layer for example, which requires a firing step, because with increase of the length of the elongated tube, oxygen necessary for decomposing organic components such as resin becomes lacking in the elongated tube or uniform coating becomes difficult. For this reason, an elongated tube whose length is relatively short is employed to form the secondary electron emission layer or the phosphor layer therein. The shorter elongated tubes are connected to each other to form one gas discharge tube, and using the discharge tubes, the display device is fabricated.

In that case, as shown in FIG. 7, the elongated tubes are longitudinally connected to each other to form one gas discharge tube, and the gas discharge tubes are arranged parallel to each other for fabricating the display device in which a connection between the elongated tubes is located in the non-discharge region A. The spacing of display pixels can be eliminated by thus locating the connection between the elongated tubes in the non-discharge regions A.

Figure 8:
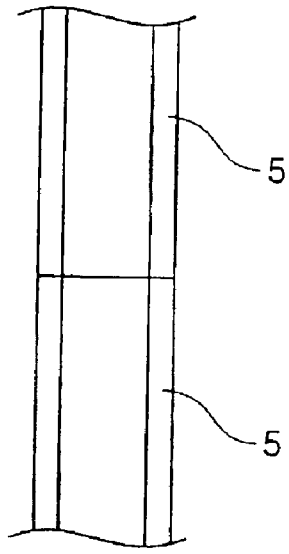
FIG. 8 is an explanatory view illustrating an example of connected elongated tubes.

FIG. 8 is an explanatory view illustrating an example of connected elongated tubes. As shown in the drawing, elongated tubes 5 are directly connected to each other to form one (i.e., a unitary) elongated gas discharge tube.

Figure 9:
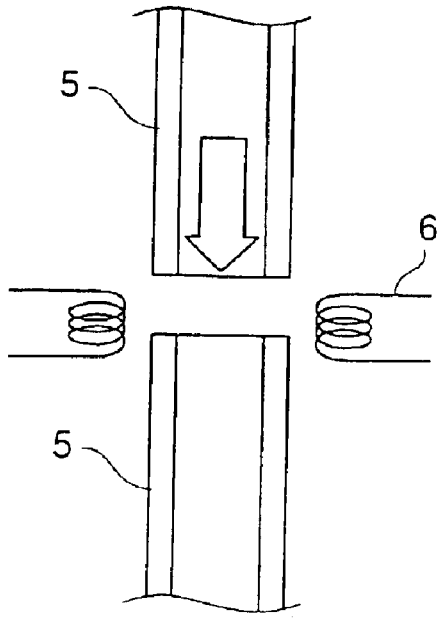
FIG. 9 is an explanatory view illustrating a method for melting the elongated tubes together by heating.
Figure 10:
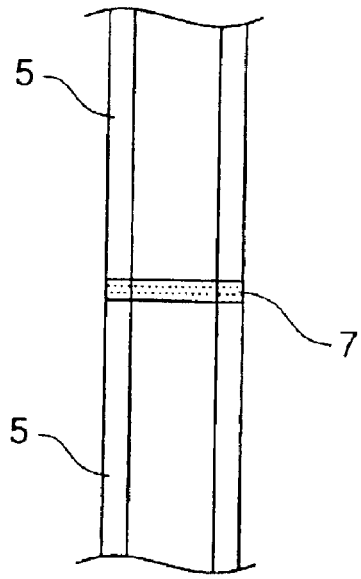
FIG. 10 is an explanatory view illustrating a state in which the elongated tubes are melted together by heating.

If the elongated tubes 5 are made of glass, they are opposed to each other and melt together by heating using heaters 6, as shown in FIG. 9. Alternatively, as shown in FIG. 10, the two elongated tubes 5 may be connected to each other with an adhesion layer 7 of, for example, low-melting glass interposed therebetween.

As mentioned above, with an increase of the length of the elongated tube, it becomes more difficult to form the secondary electron emission layer, especially, in the elongated tube. However, by thus longitudinally arranging two or more elongated tubes having the secondary electron emission layers formed therein and connecting them to each other, a long gas discharge tube can be produced. To an end of each discharge tube opposite to the connection thereof, the above-mentioned reserve tank or the getter section is connected.

Figure 11:
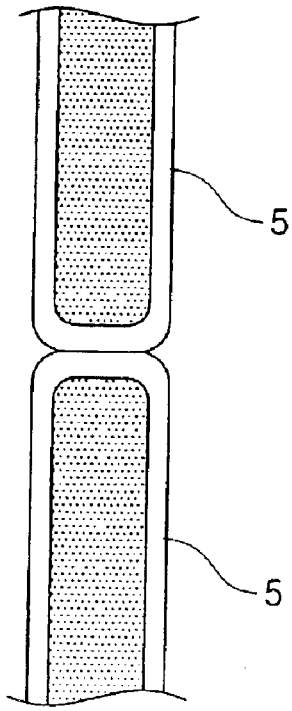
FIG. 11 is an explanatory view illustrating another example of connected elongated tubes.

FIG. 11 is an explanatory view illustrating another example of connected elongated tubes. As shown in the drawing, ends of the elongated tubes 5 may be opposed to each other to form one gas discharge tube. In that case, the end of the elongated tube is flattened so as to ensure a large luminous area. The discharge gas may be previously enclosed.

Figure 12:
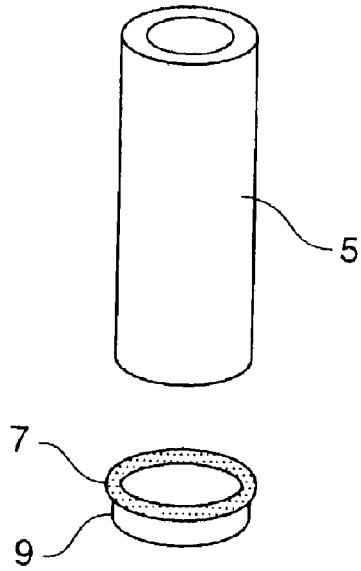
FIG. 12 is an explanatory view illustrating a state in which a thin glass plate is connected to an end of the elongated tube.

For flattening the end of the elongated tube, a thin plate glass 9 of the same thickness as the material thickness of the elongated tube 5 is employed, as shown in FIG. 12. The adhesion layer 7 of, for example, low-melting glass is formed on a surface of the thin plate glass 9, and the thin plate glass 9 is adhered to the elongated tube 5 with the adhesion layer 7 interposed therebetween.

Figure 13:
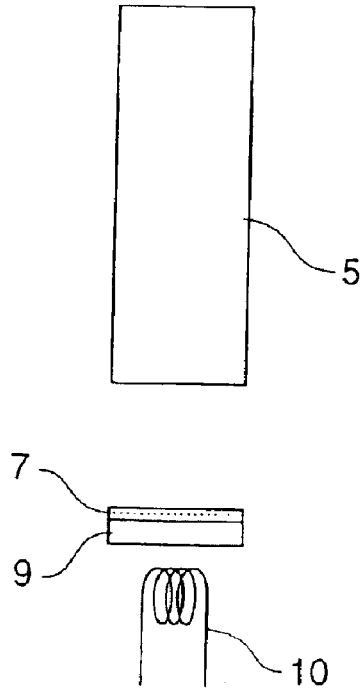
FIG. 13 is an explanatory view illustrating a method for connecting the glass plate to the end of the elongated tube.

As shown in FIG. 13, the thin plate glass 9 having the adhesion layer 7 is allowed to abut on the elongated tube 5 and adhered to an end of the elongated tube 5 by heating using a heater 10.

Thus, the ends of the elongated tubes are substantially flattened to reduce the area required for connecting the elongated tubes with their ends opposed, so that a sufficient display area can be ensured.

Figure 14:
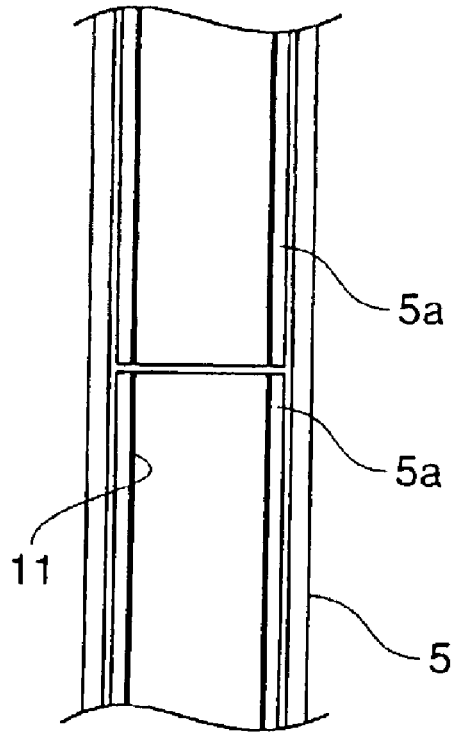
FIGS. 14(*a*) and 14(*b*) are explanatory views illustrating still another example of connected elongated tubes.
Figure 14:
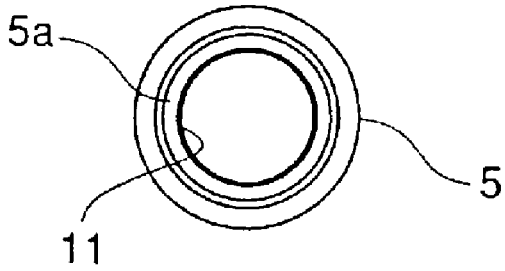

FIGS. 14(*a*) and 14(*b*) are explanatory views illustrating still another example of connected elongated tubes. FIG. 14(*a*) is a front view of a gas discharge tube and FIG. 14(*b*) is a cross sectional view thereof.

As shown in these drawings, into the longer elongated tube 5, may be inserted a plurality of elongated tubes 5*a* narrower and shorter than the elongated tube 5 to form one gas discharge tube. The narrower and shorter elongated tubes 5*a* are previously provided with, for example, the secondary electron emission layers 11 on an internal wall surface of the narrower and shorter elongated tubes 5*a*. Owing to this, the secondary electron emission layers can be favorably formed in the gas discharge tubes by forming the secondary electron emission layer 11 in each narrower and shorter elongated tube 5*a*, because oxygen necessary for decomposing the organic components is not lacking during firing.

The narrower and shorter elongated tubes can be easily connected by thus forming the secondary electron emission layers and the phosphor layers in the narrower and shorter tubes; longitudinally arranging two or more narrower and shorter elongated tubes; inserting those narrower and shorter tubes in the longer elongated tube; and enclosing the discharge gas in the narrower and shorter tubes.

Figure 15:
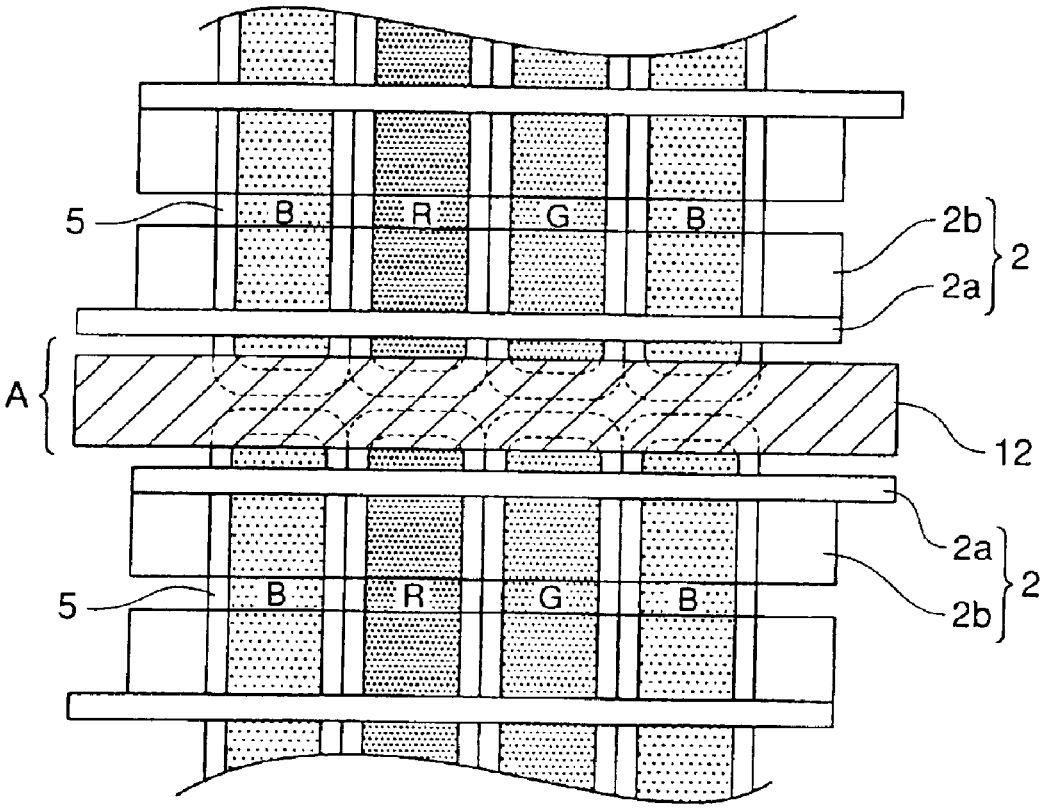
FIG. 15 is an explanatory view illustrating an example of a shielded non-discharge region of the display device.

FIG. 15 is an explanatory view illustrating an example of a shielded non-discharge region of the display device.

It is mentioned above that the connection between the elongated tubes 5 is located in the non-discharge region A. Now, a light-shielding film 12 is formed to cover the non-discharge region A. Owing to this, the connections or boundaries between the elongated tubes can be concealed, so as to prevent displayed images from being viewed as discontinuous. Also, contrast of the display device can be improved.

Thus, the gas discharge tube has the section for cleaning the discharge gas such as the reserve tank or the getter section to clean off the impurity gases generated by electric discharge, so that deterioration of the discharge characteristics by the impurity gases can be suppressed to a minimum extent. This is especially advantageous with the gas discharge tube that employs elongated tubes of a small inner volume, such as the ones of the present invention.

According to the present invention, because a section for cleaning the discharge gas is provided in the gas discharge tube to clean off the impurity gases generated during electric discharges, the discharge gas is kept clean and thereby deterioration of the discharge characteristics by the impurity gases can be prevented.

What is claimed is:

1. A display device, comprising:

front and rear substrates;

a plurality of gas discharge tubes arranged, in parallel to each other and with edges of adjacent gas discharge tubes substantially contacting, between the front and rear substrates to constitute a display screen, each gas discharge tube having a light emitting section containing a discharge gas and a cleaning section connected to the light emitting section to clean the discharge gas; and a plurality of electrodes formed on an inner surface of the front substrate so as to cross the gas discharge tubes and produce emission of light from the gas discharge tubes, wherein each cleaning section is connected to one end of a respective elongated tube and has a width substantially twice the diameter of the elongated tube, and the respective cleaning sections of adjacent gas discharge tubes are connecting to the latter at alternate ends thereof.

2. The display device of claim 1, wherein the cleaning section comprises a reserve tank filled with the same discharge gas as that enclosed in the light-emitting section so as to allow free flow of the discharge gas between the reserve tank and the light-emitting section.

3. The display device of claim 2, wherein a getter, adsorbing thereon impurity gases mixed with the discharge gas enclosed in the light-emitting section, is disposed within the reserve tank.

4. The display device of claim 3, wherein the getter has a nonvolatile characteristic.

5. The display device of claim 1, wherein the cleaning section comprises a getter section containing a getter to absorb thereon impurity gases mixed with the discharge gas enclosed in the light-emitting section.

6. The display device of claim 5, wherein the getter has a nonvolatile characteristic.

7. The display device of claim 1, wherein respective cleaning sections are connected to opposite ends of each elongated tube and have substantially the same width as the diameter of the elongated tube.

8. A display device, comprising:

front and rear substrates;

a plurality of gas discharge tubes arranged, in parallel to each other, between the front and rear substrates to constitute a display screen;

a plurality of display electrode pairs formed on an inner surface of the front substrate so as to cross the gas discharge tubes and produce emission of light from the gas discharge tubes by display discharge, wherein each gas discharge tube has a getter section, containing a getter to absorb thereon impurity gases mixed with the discharge gas, in a non-discharge region provided between predetermined display electrode pairs.

9. The display device of claim 8, wherein the getter has a nonvolatile characteristic.

10. The display device of claim 8, wherein the width of one electrode of each of the predetermined display electrode pairs is narrowed so that the distance between the predetermined display electrode pairs between which the getter section is provided is larger than the distance between the display electrode pairs between which the getter section is not provided.

11. The display device of claim 8, wherein each gas discharge tube is composed of at least two elongated tubes connected to each other in the non-discharge region, and the getter section is disposed in at least one of connected ends of the two elongated tubes.

* * * * *